US008950849B2

(12) United States Patent
Hays et al.

(10) Patent No.: US 8,950,849 B2
(45) Date of Patent: Feb. 10, 2015

(54) WATER VAPOR CONTROL STRUCTURE

(75) Inventors: Andrew W. Hays, Fairport, NY (US); Jun Ma, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 13/371,937

(22) Filed: Feb. 13, 2012

(65) Prior Publication Data

US 2013/0208057 A1 Aug. 15, 2013

(51) Int. Cl.
*B41J 2/045* (2006.01)
*B41J 2/175* (2006.01)

(52) U.S. Cl.
USPC ..... 347/71; 347/84

(58) Field of Classification Search
CPC ..... B41J 2002/16564; B41J 2/48; B41J 2/14064; B41J 2/33585; B41J 2/33505; B41J 2/335
USPC ..... 347/68, 72, 40
See application file for complete search history.

(56) References Cited

U.S. PATENT DOCUMENTS 6,076,912 A * 6/2000 Murthy ..... 347/18
6,328,430 B1 * 12/2001 Ahn et al. ..... 347/65
6,557,989 B1 * 5/2003 Hirosawa et al. ..... 347/87
6,824,241 B2 * 11/2004 Sonnichsen et al. ..... 347/20
6,924,584 B2 * 8/2005 Buhler et al. ..... 310/324
7,461,909 B2 * 12/2008 Zhang et al. ..... 347/7
8,016,387 B2 * 9/2011 Watanabe ..... 347/50
8,147,040 B2 * 4/2012 Menzel et al. ..... 347/70
8,322,830 B2 * 12/2012 Takakuwa ..... 347/71
2003/0001936 A1 * 1/2003 Hirosawa et al. ..... 347/87
2005/0036012 A1 * 2/2005 Terakura ..... 347/71
2005/0219311 A1 * 10/2005 Sugahara ..... 347/40
2006/0066690 A1 * 3/2006 Katayama ..... 347/71
2006/0103693 A1 * 5/2006 Min et al. ..... 347/44
2007/0019040 A1 * 1/2007 Seto et al. ..... 347/68
2008/0117263 A1 * 5/2008 Watanabe ..... 347/71
2008/0291243 A1 * 11/2008 Osaki ..... 347/40

* cited by examiner

*Primary Examiner* — Matthew Luu
*Assistant Examiner* — Patrick King
(74) *Attorney, Agent, or Firm* — MH2 Technology Law Group LLP

(57) ABSTRACT

In some aspects of the present application, an inkjet printing device is disclosed that can comprises an enclosed module configured to store ink and provide a path for ink flow; and an annular structure surrounding the path for ink flow, wherein the annular structure comprises a first polymer structure; a void structure arranged to surround the first polymer structure; and a second polymer structure arranged to surround the void structure.

14 Claims, 11 Drawing Sheets

CORRESPONDENCE TABLE FOR THERMAL/MOISTURE ANALOGY.

| PROPERTY | THERMAL | MOISTURE |
|---|---|---|
| PRIMARY VARIABLE | TEMPERATURE, T | WETNESS, $\omega$ |
| DENSITY | $\rho$ (kg/m$^3$) | 1 |
| CONDUCTIVITY | K (W/m·°C) | D·$C_{sat}$ (kg/s·m) |
| SPECIFIC HEAT | c (J/kg·°C) | $C_{sat}$ (kg/m$^3$) |

| MATERIAL | DENSITY (kg/m ^ 3) | DIFUSSION COEFFICENT (m ^ 2/sec) | SATURATED CONCENTRATION (kg/m ^ 3) | SATURATION % |
|---|---|---|---|---|
| | | | | |
| POLYIMIDE | 1450 | 3.00E-14 | 29 | 2.00% |
| PARYLENE | 1289 | 2.60E-13 | 0.7734 | 0.06% |

CONVERTED THERMAL PROPERTY FOR MOISTURE DIFFUSION

| | | POLYIMIDE | PARYLENE |
|---|---|---|---|
| | | | |
| THERMAL CONDUCTIVITY | k(kg/hr.m) | 3.13E-09 | 7.24E-10 |
| SPECIFIC HEAT | c(kg/m ^ 3) | 29 | 0.7734 |
| DENSITY | ρ(kg/m ^ 3) | 1 | 1 |

FIG. 4

MOISTURE AT CIRCLE: T = 1
MOISTURE IN MOAT: T=0

Case 7+coating: (radial diffusion from a humidified 254um diameter hole in a sheet bounded by a dry moat)

D=3.0e-14 m^2/s

Circle cutout inner: R = 127um

Circle cutout outer: R = 152um

Moisture at circle: T = 1

Moisture in moat T=0

Cycling (24hr humid, 16 hr dry)

WATER VAPOR CONTROL STRUCTURE

DESCRIPTION OF THE DISCLOSURE

1. Field of the Disclosure

Aspects of the present disclosure are related to printhead assemblies and in particular to a device and method for controlling moisture within portions of printhead assemblies.

2. Background of the Disclosure

Solid ink jet printing machines include printheads that include one or more ink-filled channels communicating at one end with an ink supply chamber or reservoir and having an orifice at the opposite end, commonly referred to as the nozzle. An energy generator, such as a piezo-electric transducer, is located within the channels near the nozzle to produce pressure pulses. Another type system, known as thermal ink jet or bubble jet, produces high velocity droplets by way of a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble.

Ink jet printheads typically require multiple layers of materials as part of their fabrication. Traditional methods use layers of gold plated stainless steel sheet metal with photo chemically etched features which are brazed together to form robust structures. However, with the continued drive to improve cost and performance, use of alternate materials and bonding processes are required. Polymer layers can replace certain sheet metal components and can be used to lower the cost of solid ink printheads, but most of these polymers absorb and are permeable to water. Some products including polymer-based printheads may be required or are shut off each night for a variety of reasons including to obtain regulatory approval. When the ink freezes it tends to shrink away from the sides of the fluid path, thus exposing the surfaces to moisture containing air where moisture from the surrounding air can enter into the printhead structure and diffuse into the polymer. When the printhead is heated, the moisture can outgas forming steam bubbles in the head, which can cause missing jets. If the timescale for the outgassing, which depends on the diffusion properties of the material and the geometry, is fairly short the steam bubbles can be purged away. However, outgassing from the exposed edges of films can occur for hours during which time the printhead is unusable.

Typical polymer-based materials used in ink jet printhead including, for example, Ube Upilex and DuPont ELJ, which are both polyimide based, as well as flexible thermoset adhesive have a tendency to absorb moisture. Due to environmental consideration many products using these printheads will be turned off every night and the printheads will undergo a complete freeze/thaw cycle. Upon freezing, the ink contracts and tends to delaminate from the inner surfaces of the actuator. Once the delamination occurs, environmental moisture may be freely absorbed at the polymer surface. Geometry is an important factor in the uptake rate for a layer of polymer. Sheets of polymer with their surface exposed will uptake moisture much quicker than sheets whose edges only are exposed. Surface exposed sheets also outgas more quickly and it has been observed that this most likely occurs on a time scale that is within the printhead warmup process. However, edge exposure can slow the rate of outgassing to a time period up to 3 hours, which is unacceptable. Thus, an improved printhead is needed to remedy these deficiencies.

SUMMARY OF THE DISCLOSURE

In accordance with some aspects of the present disclosure, an inkjet printing device is disclosed. The inkjet printing device can comprise an enclosed module configured to store ink and provide a path for ink flow; and an annular structure surrounding the path for ink flow, wherein the annular structure comprises a first polymer structure; a void structure arranged to surround the first polymer structure; and a second polymer structure arranged to surround the void structure.

The void structure of the inkjet printing device can be arranged to provide a break for moisture diffusion and/or can be arranged to be coupled to a moisture sink.

In some aspects, the moisture sink can be arranged to be vented to an atmosphere or maintained as a dry space through vacuum or desiccant.

In some aspects, an inner surface of the first polymer structure can be arranged to be in contact with the ink is coated with a moisture-resistant coating. The moisture-resistant coating can comprise parylene, wherein the parylene can be about 5 μm thick.

In some aspects, the enclosed module of the inkjet printing device can comprise a polymer material.

In some aspects of the present disclosure, a method for inkjet printing is disclosed. The method can comprise enclosing a module configured to store ink and providing a path for ink flow; and surrounding the path for ink flow with an annular structure surrounding, wherein the annular structure comprises a first polymer structure; a void structure arranged to surround the first polymer structure; and a second polymer structure arranged to surround the void structure.

The method can further comprise arranging the void structure to provide a break for moisture diffusion. The method can further comprise arranging the void structure to be coupled to a moisture sink. The method can further comprise arranging the moisture sink to be vented to an atmosphere or maintaining the moisture sink as a dry space through vacuum or desiccant. The method can further comprise arranging an inner surface of the first polymer structure to be in contact with the ink is coated with a moisture-resistant coating. The moisture-resistant coating comprises parylene, wherein the parylene is about 5 μm thick. The enclosed module can comprise a polymer material.

Additional embodiments and advantages of the disclosure will be set forth in part in the description which follows, and can be learned by practice of the disclosure. The embodiments and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and, together with the description, serve to explain the principles of the disclosure.

BRIEF DESCRIPTION OF THE DRAWINGS

FIG. 4 shows details of an analysis that was performed using a thermal/moisture analogy within ABAQUS in accordance with aspects of the present disclosure.

DESCRIPTION OF THE EMBODIMENTS

Reference will now be made in detail to various exemplary embodiments of the present application, examples of which are illustrated in the accompanying drawings. Wherever possible, the same reference numbers will be used throughout the drawings to refer to the same or like parts.

Aspects of the present disclosure relate to a device and method to reduce the impact of absorbed water vapor in polyimide and other polymers in ink jet printheads. Absorbed water in room temperature printheads can create bubbles of water vapor when the printhead is heated for operation with solid inks, which can negatively impact print quality. By isolating the places where ink passes through the polymer plates, for example by cutting an annulus around the pass through so that there is a polyimide wall, an air gap and then the rest of the polyimide film, the impact of the absorbed water vapor can be reduced. The annulus of air can reduce the amount of moisture absorbed by the polyimide film and reduce the quantity and shorten the time for vapor release when the moisture is able to diffuse out of the air pockets surrounding the annulus. Further, evacuating the annulus can keep the moisture level still lower. Analysis has been performed by a simple model of diffusion of water vapor in a polyimide annulus, which has shown benefits including reducing the number of vapor bubbles that occur when the head is warmed up from the cold state and shortening the time for which bubbles are released to a timescale that might be acceptable for printhead warmup.

Figure 1:
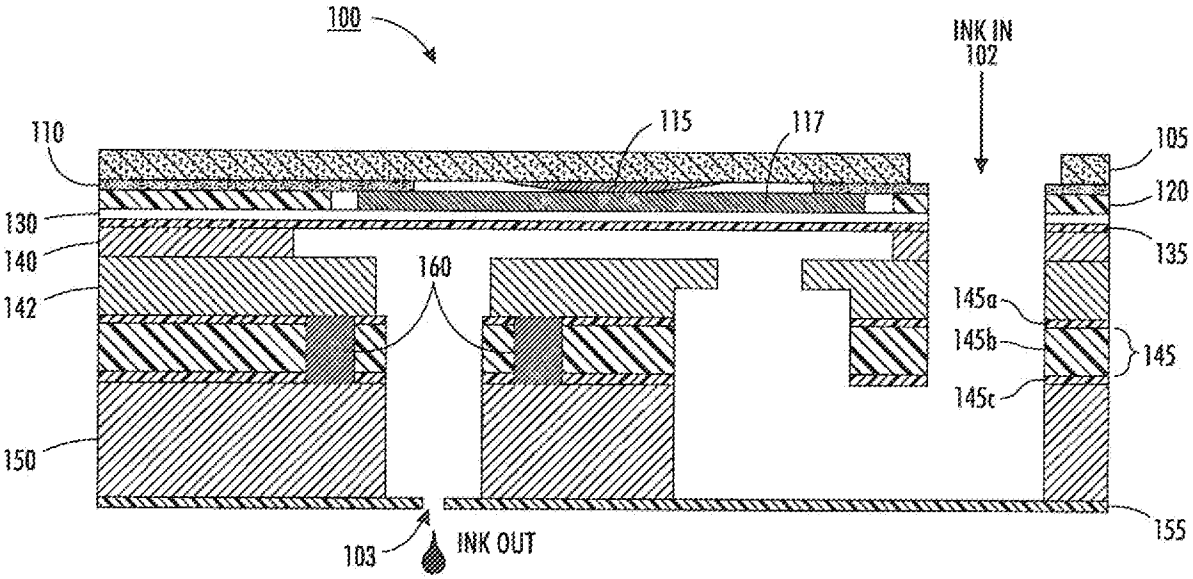
FIG. 1 shows an example cross-sectional view of printhead assembly for inkjet printing machines in accordance with aspects of the present disclosure.

FIG. 1 shows an example cross-sectional view of printhead assembly 100 for inkjet printing machines. Assembly 100 can comprise a series of functional plates, each performing an ascribed function for controlled dispensing of the molten ink onto a substrate passing by the assembly. In a particular embodiment, the printhead assembly 100 can comprise an ink flow inlet path 102 and an ink flow outlet path 103 that passes through layers of stackup comprising (layers from top to bottom in the figure) flexible circuit layer 105 (about 0.003" in thickness) composed of a flex circuit material, layer comprising Standoff layer 110 (about 0.001" in thickness) composed of a flexible, thermoset adhesive and a flexible, electrically conductive epoxy 115, layer comprising Spacer layer 120 (about 0.002" in thickness) composed of a polyimide material and piezoelectric material 117, diaphragm layer 130 (about 0.0008" in thickness) composed of stainless steel, Diaphragm Adhesive layer 135 (about 0.001" in thickness) composed of polyimide base films include, for example, thermoplastic polyimide film ELJ—from DuPont, body layer 140 (about 0.003" in thickness) composed of stainless steel, Body Outlet A 142 (about 0.006" in thickness) composed of stainless steel, Body Outlet B 150 (about 0.010" in thickness) composed of stainless steel, polymer layer 145 comprising adhesive ELJ layer 145*a* manufactured by DuPont, polyimide layer 145*b*, and adhesive ELJ layer 145*c* manufactured by DuPont, stainless steel layer 150 (about 0.010" in thickness), and aperture layer 155 (about 0.001" in thickness) composed of a polyimide material. A structure 160 (described further below) can be arranged in polymer layer 145 around the ink flow outlet path 103 to assist in the reduction or elimination of moisture laden air from ambient migrating through aperture layer 155 to polymer layer 145 where ink may solidify or freeze at or near certain lower temperatures and contract away from the polyimide layer. For example structure 160 can be arranged as an annular void providing an area of vacuum (including partial vacuum). To bond any combination of stainless, aluminum or polyimide layers requires a thin film adhesive, such as ELJ, which is a commercially available thermoset polyimide film from DuPont Corporation or a flexible, thermoset adhesive.

Figure 2:
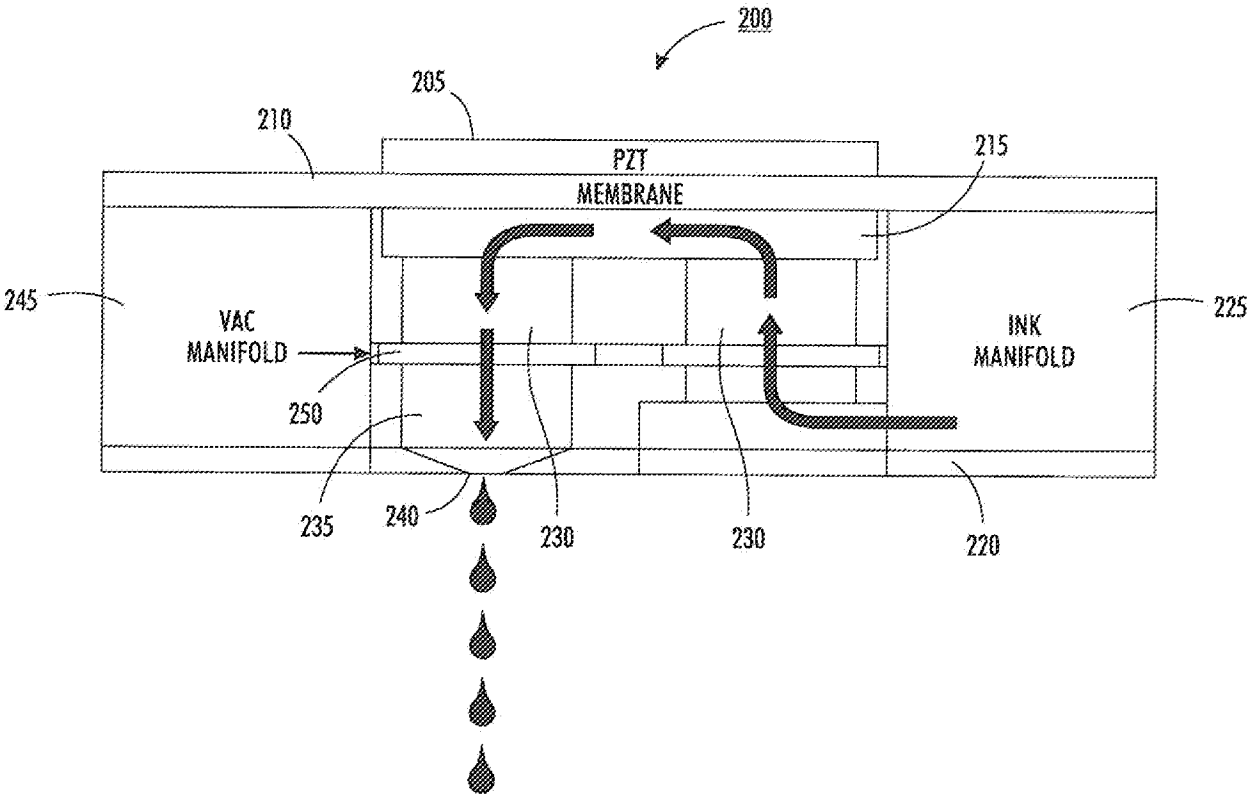
FIG. 2 shows another example printhead assembly for inkjet printing machines in accordance with aspects of the present disclosure.
Figure 3A:
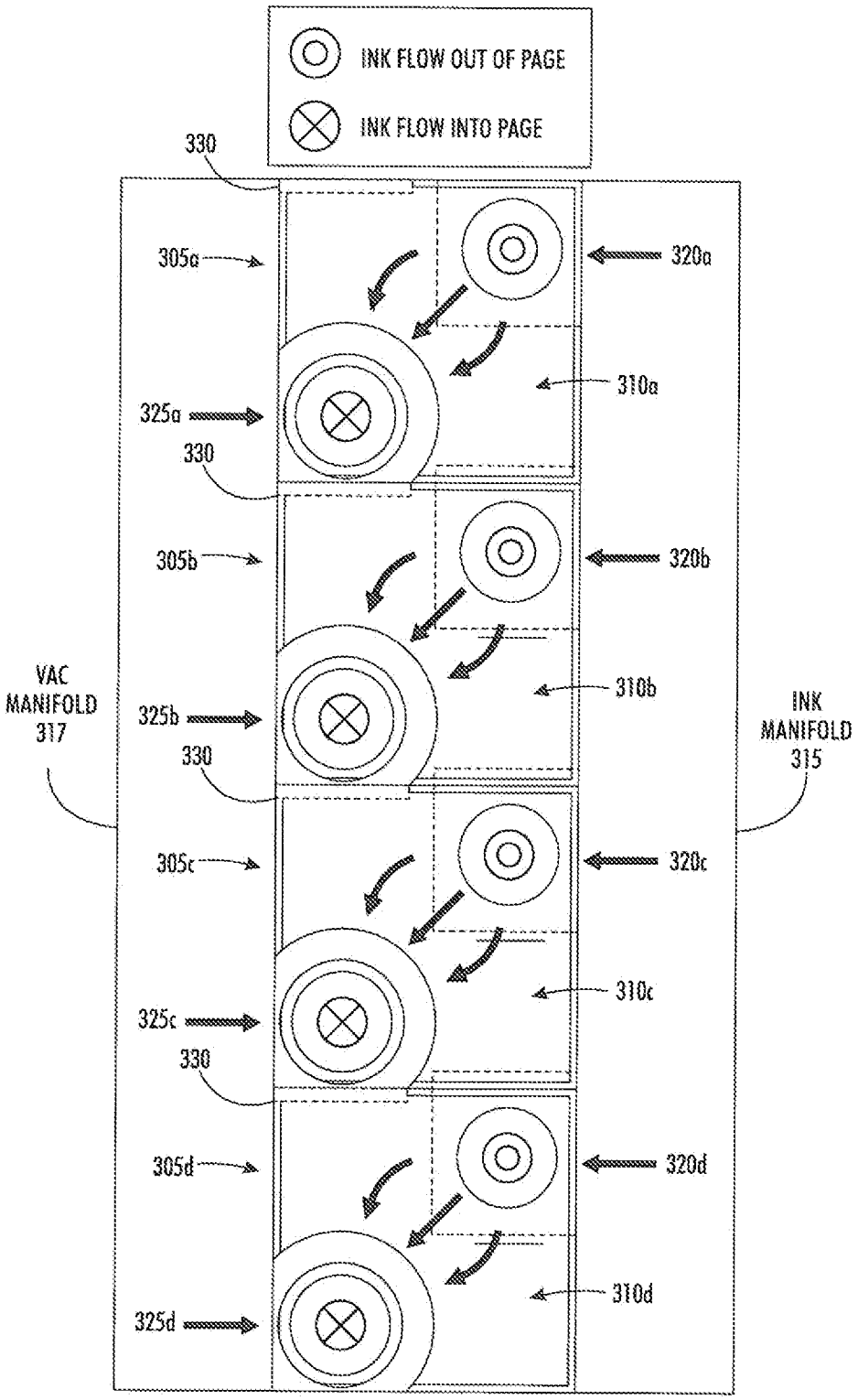
FIGS. 3*a*, 3*b*, 3*c* and 3*d* show a top, side, and two angled perspective views, respectively, of three actuators within the printhead assembly of FIG. 2.
Figure 3B:
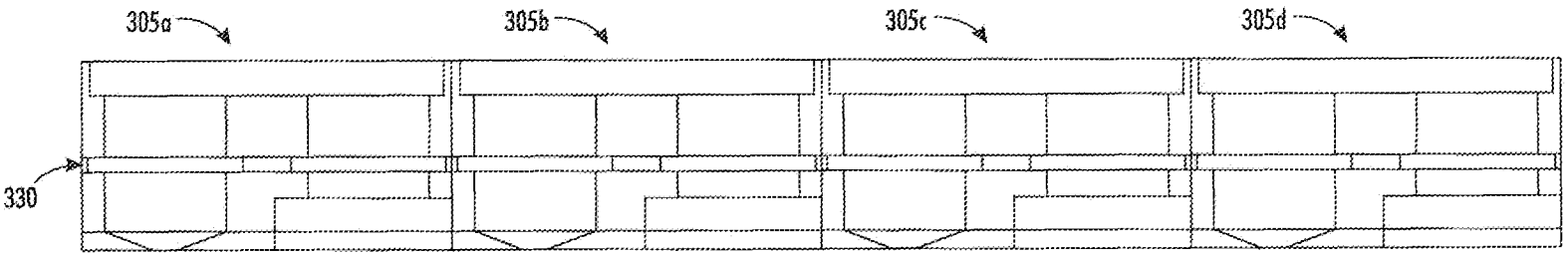
Figure 3C:
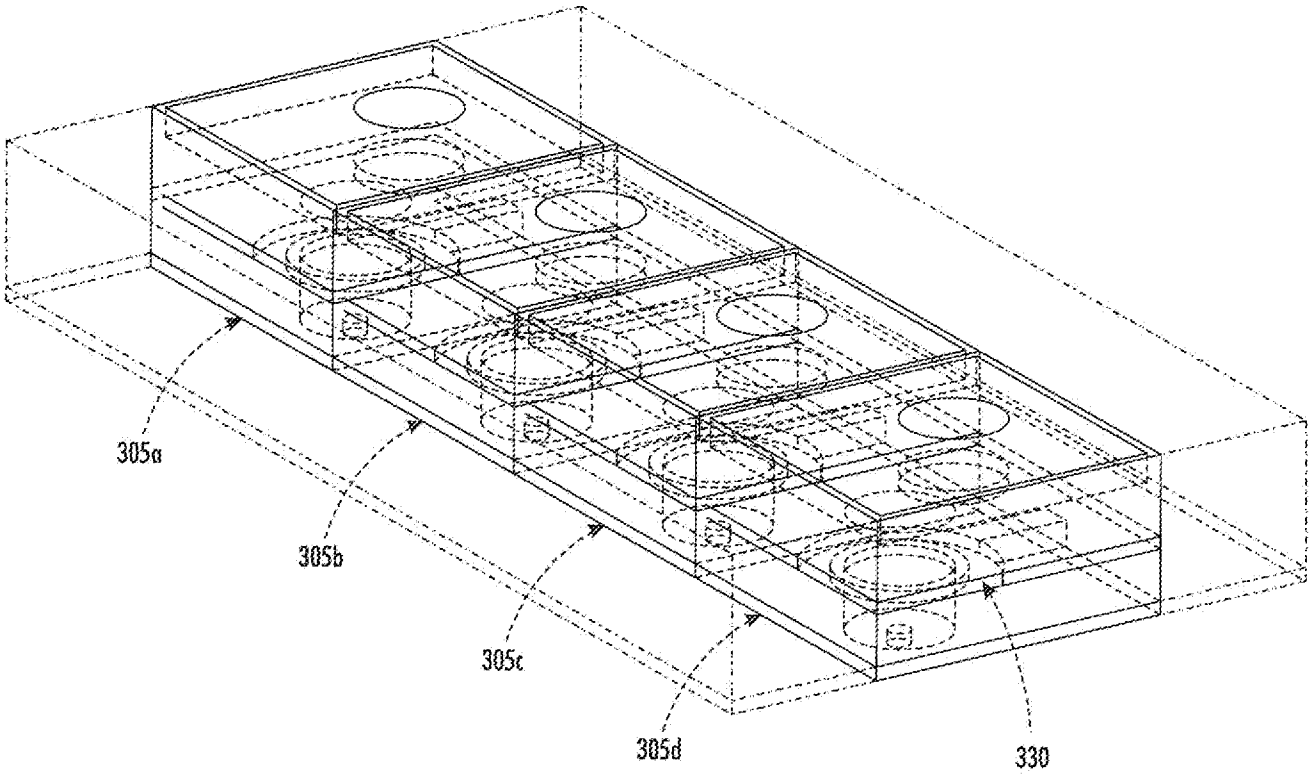
Figure 3D:
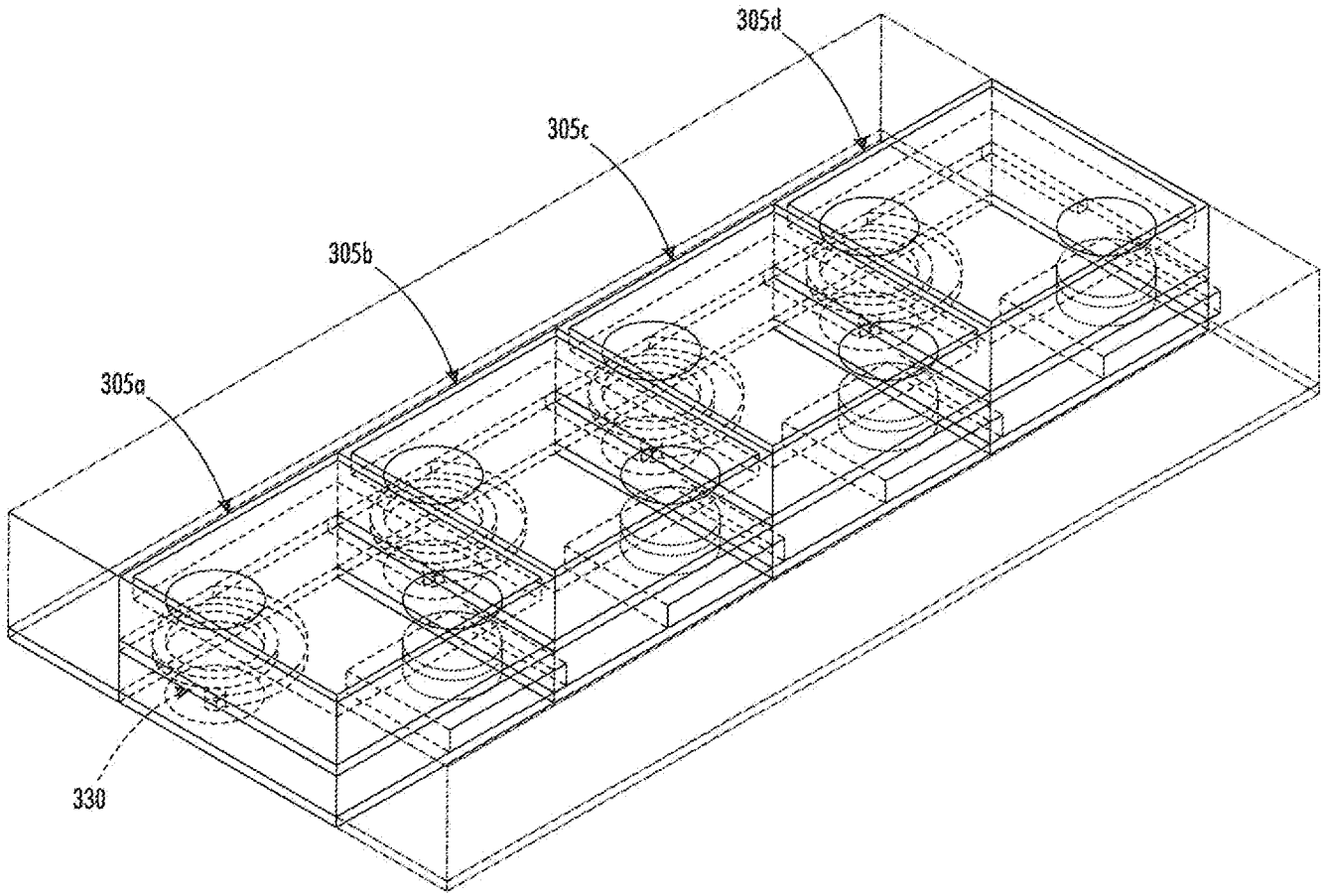

FIG. 2 shows another example printhead assembly 200 for inkjet printing machines. The printhead assembly includes piezoelectric (PZT) component 205, membrane portion 210, and body portion 215. The membrane portion 210 is operable to provide an interface between the ink and the PZT and is arranged to form a flexible, sealed wall of the body chamber. When the PZT is actuated, the membrane portion 210 is operable to deflect to first draw ink into the body and then deflects the opposite way to pressurize and eject ink from the actuator. In the body portion 215, Ink 220 flows from ink manifold 225, which is operable to distribute ink 220 to individual actuators 230 (one of which is shown in FIG. 2 for simplicity; however, FIGS. 3*a*-3*d* shows a plurality of actuators) and through outlet 235 and nozzle 240. Vacuum manifold 245 is arranged around at least a portion of actuator 230 to deliver at least a partial vacuum to an area around each polymer ring 250. In some aspects, the position of the ink and/or vacuum manifolds in the flow path can be further upstream with individual inlet paths for ink and/or vacuum leading to each actuator.

FIGS. 3*a*, 3*b*, 3*c* and 3*d* show a top, side, and two angled perspective views, respectively, of four actuators 305*a*, 305*b*, 305*c*, and 305*d* within the printhead assembly of FIG. 2. Ink flow paths 310*a*, 310*b*, 310*c*, and 310*d* from ink manifold side 315 to vacuum manifold side 317 is shown where the ink flows from ink inlets 320*a*, 320*b*, 320*c*, and 320*d* to ink outlets 325*a*, 325*b*, 325*c*, and 325*d*. Moisture lining structure 330 can be arranged within the printhead assembly to provide voids adjacent to polymer structures that are exposed to ambient air such as when the printhead is turned off and the ink shrinks away from the jet outlet sidewalls upon freezing. The structure can be used to limit the volume of polymer into which moisture can absorb. Upon reheating the printhead, moisture can outgas from the surface in contact with the void reducing the amount of outgassing into the ink. Structure 330 can be arranged as an annulus composed of a polyimide material.

These voids may be connected to vacuum or a dry environment to limit the total amount of moisture absorption. Additionally, a low permeability/solubility coating between the polymer and the ink contacting surface could be used to bias the water vapor diffusion towards the void. The water vapor would be preferentially driven into the vented void due to the lower resistance of the uncoated path versus through the low permeability coating further reducing outgassing into the ink. This would minimize or prevent water vapor bubbles from condensing in the ink which cause the missing jets.

Figure 8:
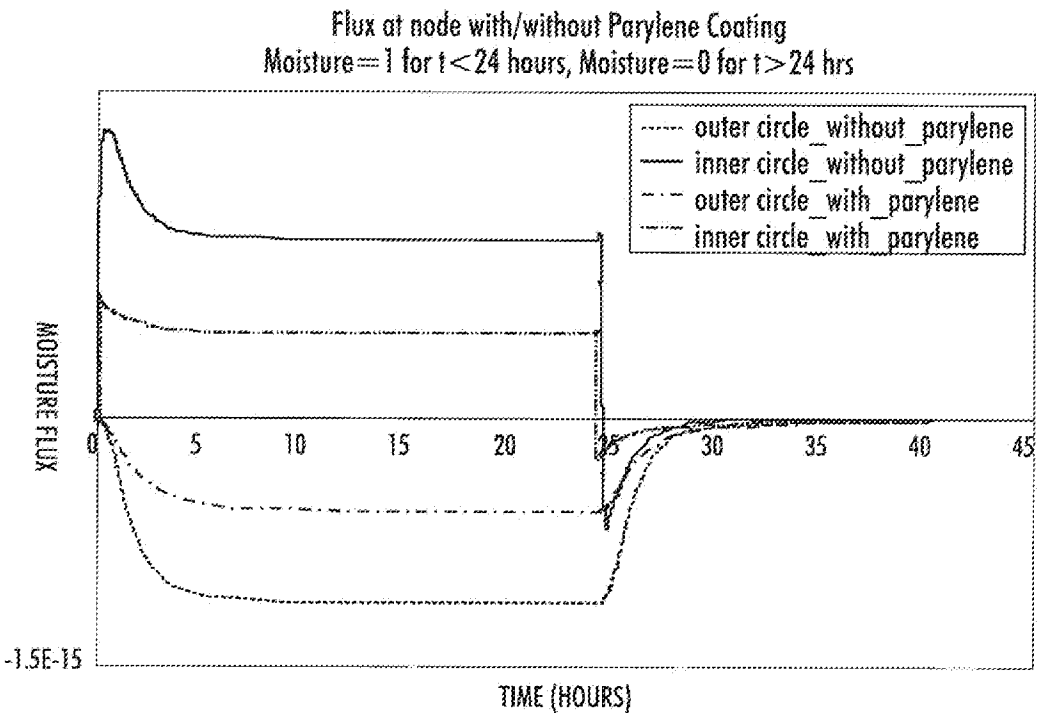
FIG. 8 shows a graph comparing non-parylene coated and parylene coated inner surface in accordance with aspects of the present disclosure.

FIG. 4 shows details of an analysis that was performed using a thermal/moisture analogy within ABAQUS, which is a suite of software applications for finite element analysis and computer-aided engineering, and shows how the thermal and moisture variables map to each other and the values used for polyimide and the moisture barrier coating parylene. The correspondence table in FIG. 8 is from "The Finite Element Method and Applications in Engineering Using ANSYS by Erdogan Madenci and Ibrahim Guven. Springer 2006 ISBN 978-0387-28289-3, page 551.

Figure 5:
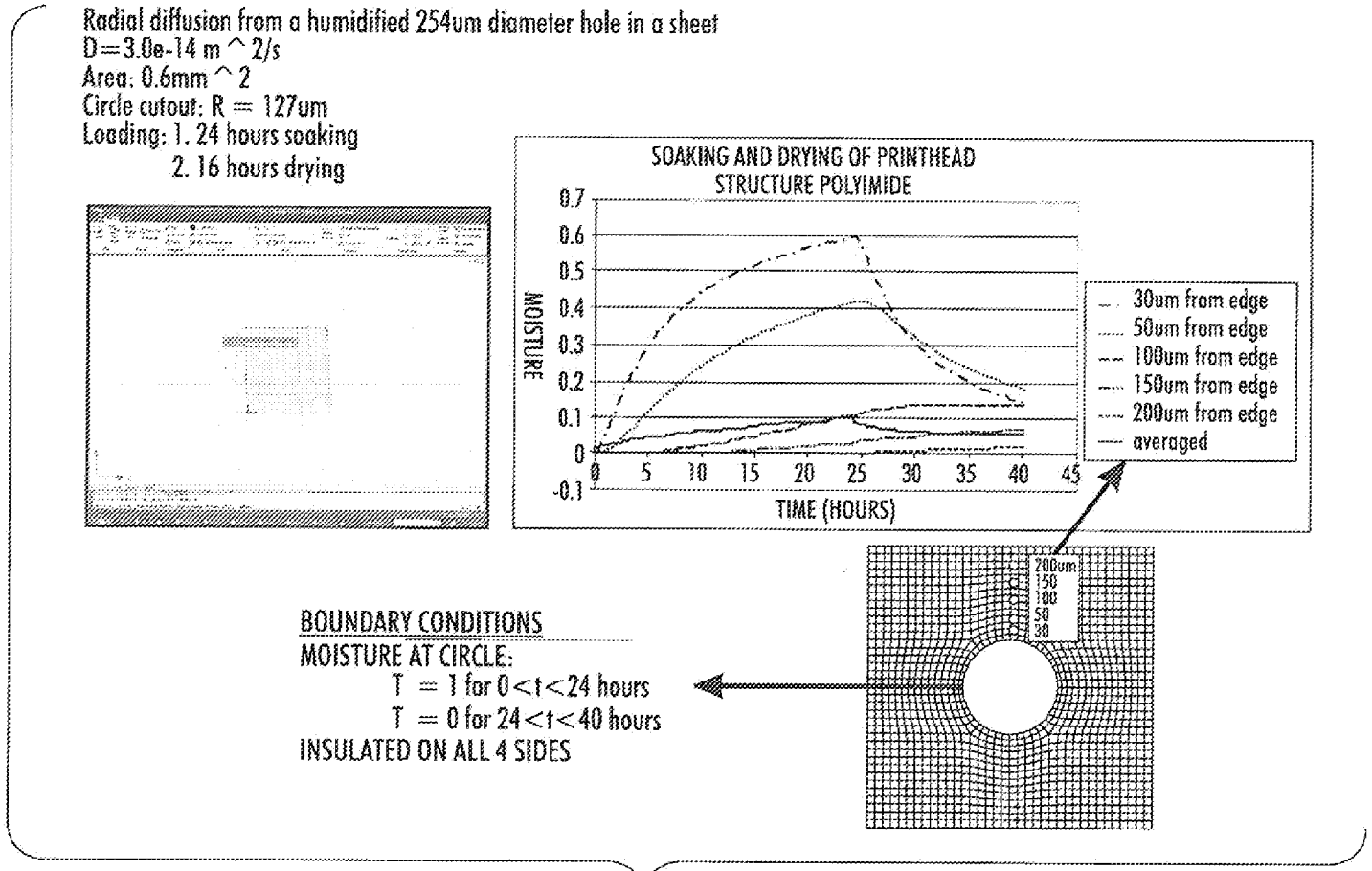
FIG. 5 shows results of the analysis for a normalized moisture uptake into polyimide through the exposed edge of a 254 μm diameter hole as a function of time in accordance with aspects of the present disclosure.

FIG. 5 shows results of the analysis for a normalized moisture uptake into polyimide through the exposed edge of a 254 μm diameter hole as a function of time. The first 24 hours are with a boundary condition value of 1 (humid) in the hole and the remaining 16 hours are with a value of 0 (dry). The curve shows the average moisture level (normalized to a saturation level of 1) for a unit cell corresponding to a printhead structure unit cell (box in the upper left diagram).

In some aspects, portions of material around the fluid path walls can be removed and a break for moisture diffusion can be created. The void can be connected to a moisture sink and can be then either will be vented to atmosphere or maintained as a dry space through vacuum or desiccant. There are two important functions this structure accomplishes. The first is that the total mass of moisture laden material directly in contact with the fluid path has been reduced significantly. Therefore, the total amount of moisture available to form bubbles is also reduced and the distance that the moisture travels and therefore the time of outgassing is substantially reduced. The second is that if the void is maintained in a dry state during the freeze time a moisture gradient is established which further reduces the total amount of moisture in the polymer by about factor of two.

Figure 6A:
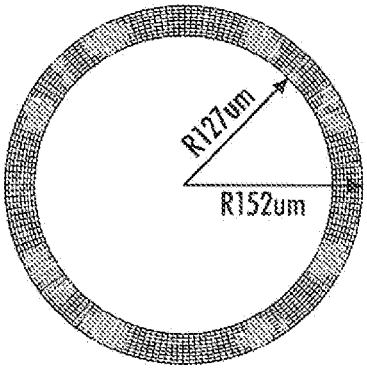
FIGS. 6*a* and 6*b* show an example 25 μm thick ring with moisture level of 1 applied to the inner surface and 0 applied to the outer surface in accordance with aspects of the present disclosure.
Figure 6B:
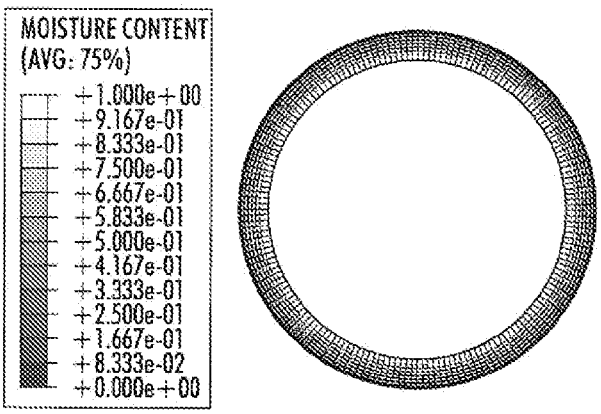
Figure 6C:
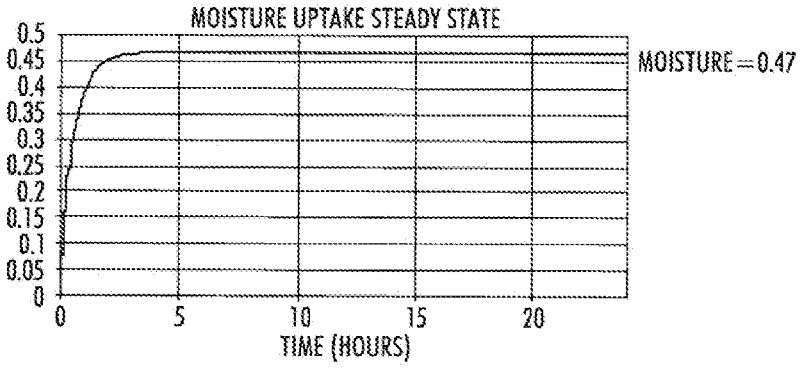
FIG. 6*c* shows results of a modeling analysis for the structure of FIGS. 6*a* and 6*b* in the form of a plot of moisture concentration versus time in hours in accordance with aspects of the present disclosure.

If the void is maintained in a dry state then the material beyond the ring is of no consequence from a modeling perspective. FIGS. 6*a* and 6*b* show an example 25 μm thick ring with moisture level of 1 applied to the inner surface and 0 applied to the outer surface. FIG. 6*c* shows results of a modeling analysis for the structure of FIGS. 6*a* and 6*b* in the form of a plot of moisture concentration versus time in hours. The steady state gradient is shown in the upper right where the ring was found to reach a steady state moisture concentration level of about 0.47 after 3 hours.

Figure 7A:
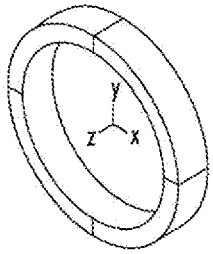
FIG. 7*a* shows an example ring structure with parylene applied to the inner surface of the flow path in accordance with aspects of the present disclosure.
Figure 7B:
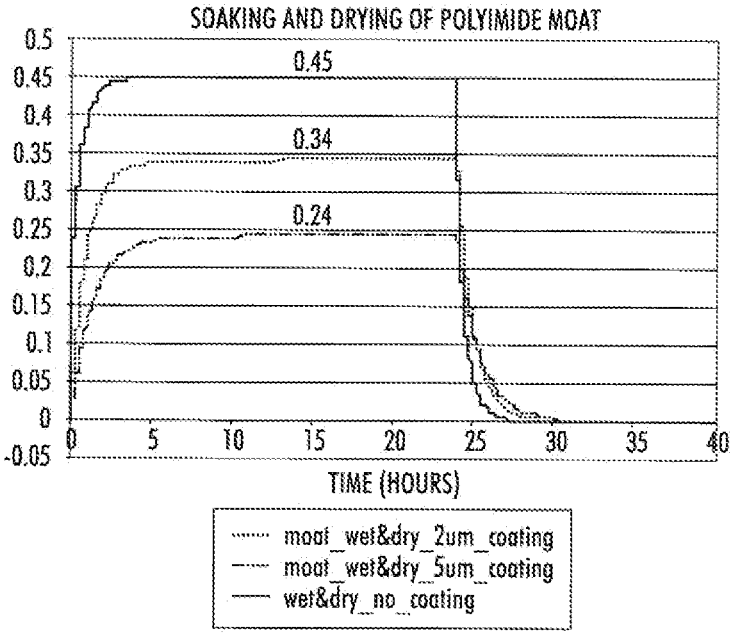
FIG. 7*b* shows results of a modeling analysis for the structure of FIG. 7*a* in the form of a plot of moisture concentration versus time in hours in accordance with aspects of the present disclosure.

FIG. 7*a* shows an example ring structure with parylene applied to the inner surface of the flow path. Other suitable materials besides parylene can be applied such as thin metal films, polyurethane and UV/light curable resins. The parylene can act as a moisture coating to enhance the effect of the void. FIG. 7*b* shows results of a modeling analysis for the structure of FIG. 7*a* in the form of a plot of moisture concentration versus time in hours. As can be seen in the plot, a 5 μm thick parylene coating was shown to reduce the average steady state moisture content of the polymer by a factor of two.

The parylene also shifts the outgassing towards the void and away from the ink. FIG. 8 shows a graph comparing non-parylene coated and parylene coated inner surface and shows how the moisture flux through the inner and outer surfaces achieves steady state using a boundary condition of wet (1) at the inner surface and dry (0) at the outer surface. At 24 hours the inner boundary condition is switched to dry and the outgassing level through both surfaces can be observed. The parylene coating was found to reduce the outgassing from the inner surface (bottom curve) by about a factor of 4 relative to the uncoated (top) curve.

In some aspect, the ring structure can have a cross-sectional area of $2.2\times10^{-4}$-$cm^2$ compared to a type of printhead assembly unit cell with $6\times^{10-3}$ $cm^2$ area, such that there is 27 times less material in ring structures discussed above. Assuming a moisture gradient through the ring, there will be 27/0.5=54 times less moisture available for outgassing. Moreover, considering that much of the moisture outgases into the void where it is not a problem and the possible use of a coating such as parylene, there can be a 2 orders of magnitude decrease in the level of outgassing into the ink.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an acid" includes two or more different acids. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A solid ink inkjet printing device comprising:

an enclosed ink manifold module configured to store solid ink and provide a path for ink flow; and an annular structure surrounding the path for ink flow, wherein the annular structure comprises a first polymer structure; a void structure arranged to surround the first polymer structure; and a second polymer structure arranged to surround the void structure, wherein the void structure is arranged to provide a break for moisture diffusion caused by a volume change in the solid ink during a phase change in the solid ink.

2. The solid ink inkjet printing device according to claim 1, wherein an area in the void structure is arranged to be at least a partial vacuum.

3. The solid ink inkjet printing device according to claim 2, wherein the area in the void structure is arranged to be vented to an atmosphere or maintained as a dry space through vacuum or desiccant.

4. The solid ink inkjet printing device according to claim 1, wherein an inner surface of the first polymer structure arranged to be in contact with the ink is coated with a moisture-resistant coating.

5. The solid ink inkjet printing device according to claim 4, wherein the moisture-resistant coating comprises parylene.

6. The solid ink inkjet printing device according to claim 5, wherein the parylene is about 5 μm thick.

7. The solid ink inkjet printing device according to claim 1, wherein the enclosed module comprises a polymer material.

8. A method for solid ink inkjet printing comprising:

enclosing a ink manifold module configured to store solid ink and providing a path for ink flow; and surrounding the path for ink flow with an annular structure surrounding, wherein the annular structure comprises a first polymer structure; a void structure arranged to surround the first polymer structure; and a second polymer structure arranged to surround the void structure, wherein the void structure is arranged to provide a break for moisture diffusion caused by a volume change in the solid ink during a phase change in the solid ink.

9. The method according to claim 8, further comprising arranging an area in the void structure to be at least a partial vacuum.

10. The method according to claim 9, further comprising arranging the area in the void structure to be vented to an atmosphere or maintaining the moisture sink as a dry space through vacuum or desiccant.

11. The method according to claim 8, further comprising arranging an inner surface of the first polymer structure to be in contact with the ink is coated with a moisture-resistant coating.

12. The method according to claim 11, wherein the moisture-resistant coating comprises parylene.

13. The method according to claim 12, wherein the parylene is about 5 μm thick.

14. The method according to claim 1, wherein the enclosed module comprises a polymer material.

* * * * *